US005788259A

United States Patent [19]

Emig

[11] Patent Number: 5,788,259

[45] Date of Patent: Aug. 4, 1998

[54] SKI COMPOSED OF SEVERAL ELEMENTS

[75] Inventor: Uwe Emig, Gartenstrasse 29, D-62429 Waldbrunn, Germany

[73] Assignees: Uwe Emig, Waldbrunn; Markus Gramlich, Ober-Ramstadt, both of Germany

[21] Appl. No.: 557,166

[22] PCT Filed: Jul. 24, 1994

[86] PCT No.: PCT/DE94/00851

§ 371 Date: Dec. 20, 1995

§ 102(e) Date: Dec. 20, 1995

[87] PCT Pub. No.: WO95/03859

PCT Pub. Date: Feb. 9, 1995

[30] Foreign Application Priority Data

Jul. 27, 1993 [DE] Germany ..... 43 25 091.2

[51] Int. Cl.[6] ..... A63C 5/04

[52] U.S. Cl. ..... 280/609; 280/610

[58] Field of Search ..... 280/601, 602, 280/608, 609, 610; 441/68

[56] References Cited

U.S. PATENT DOCUMENTS

| | | | |
|---|---|---|---|
| 3,416,810 | 12/1968 | Kennedy, III | 280/610 |
| 3,493,240 | 2/1970 | Jenks | 280/610 |
| 3,612,556 | 10/1971 | Seawell | 280/610 |
| 3,894,745 | 7/1975 | Heim et al. | 280/610 |
| 3,928,106 | 12/1975 | Molnar | 156/210 |
| 5,141,243 | 8/1992 | Meatto | 280/602 |
| 5,299,822 | 4/1994 | Mayr et al. | 280/610 |
| 5,449,425 | 9/1995 | Renard et al. | 156/78 |

FOREIGN PATENT DOCUMENTS

| | | | |
|---|---|---|---|
| 419779 | 7/1990 | Austria | 210/610 |
| 734828 | 5/1966 | Canada | 280/610 |
| 917688 | 12/1972 | Canada | 280/610 |
| 0 081 834 | 6/1983 | European Pat. Off. . | |
| 2 610 525 | 8/1988 | France . | |
| 1 875 939 | 3/1963 | Germany . | |
| 441082 | 7/1967 | Germany | 280/610 |
| 1428854 | 12/1968 | Germany | 280/610 |
| 1 948 679 | 4/1970 | Germany . | |
| 1 578 716 | 8/1970 | Germany . | |
| 1 578 700 | 2/1971 | Germany . | |
| 2 332 909 | 6/1973 | Germany . | |
| 24 33 673 | 2/1975 | Germany . | |
| 34 27 111 A1 | 1/1986 | Germany . | |
| 38 03 535 A1 | 9/1988 | Germany . | |
| WO 91/06350 | 5/1991 | Germany . | |
| 39 25 491C2 | 8/1991 | Germany . | |
| 1173199 | 12/1969 | United Kingdom | 280/610 |

*Primary Examiner*—Brian L. Johnson
*Assistant Examiner*—Bridget Avery
*Attorney, Agent, or Firm*—Nikaido, Marmelstein, Murray & Oram LLP

[57] ABSTRACT

In a ski with a body consisting of several elements that are arranged parallel and in layers and connected by adhesives and/or form-fit into each other it is proposed to arrange shaped elements (12, 13, 16) in layers that extend over most of the length of the ski body and consist of a supporting element (16) that is provided with longitudinal cavities (20, 21) in which the longitudinal ribs provided for this purpose on two anti-shock elements (12, 13) are inserted. Anti-shock layers (14, 15) of an elastomer material are inserted between the elements (12, 13, 16). The ski is characterized by good shock absorption properties and even running.

19 Claims, 3 Drawing Sheets

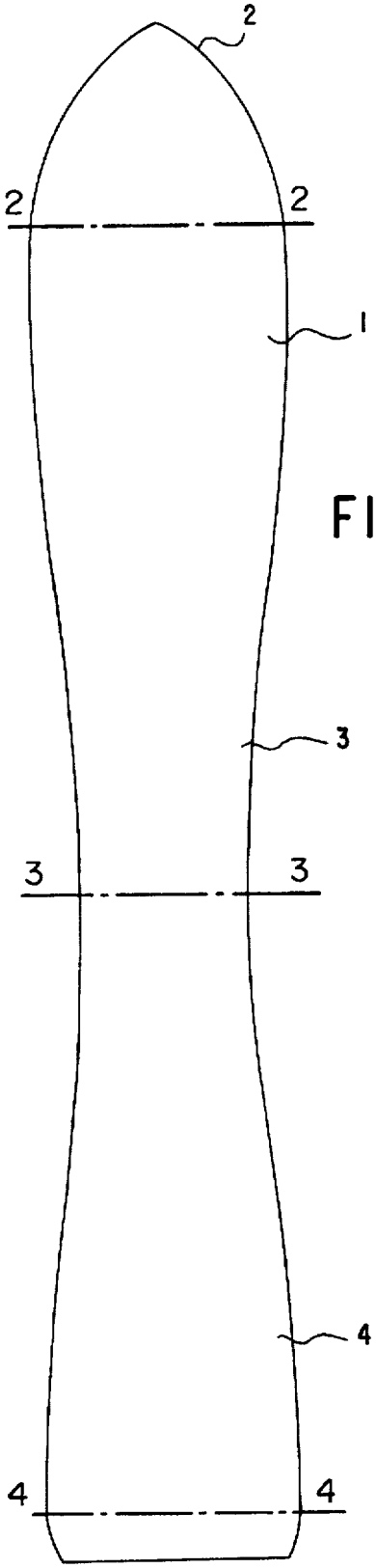
FIG.1
FIG.2
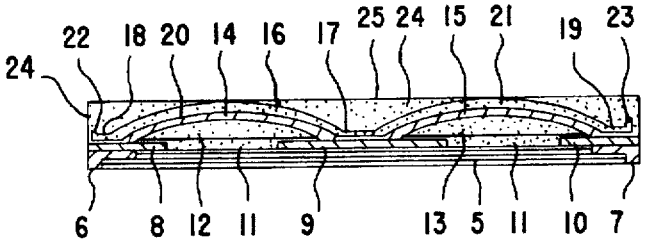
FIG.3
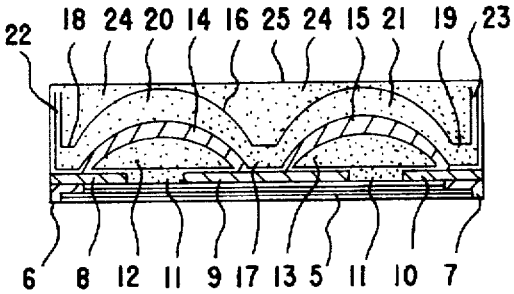
FIG.4
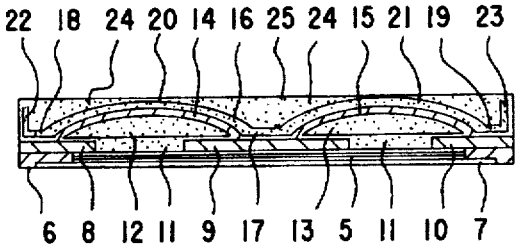

SKI COMPOSED OF SEVERAL ELEMENTS

The disclosed invention is a ski with a body consisting of several elements that are arranged beside and/or on top of the other. The elements are connected by adhesives and/or form-fit into each other. The ski consists of a minimum of two elements that are arranged one on top of the other and extend over almost the total length of the ski body. One of these two shaped parts has a longitudinal cavity in which a longitudinal rib of the other element engages.

BACKGROUND OF THE INVENTION

A ski of the type described above is known from DE-OS 23 32 909 and DE-OS 34 27 111. The skis described in these patents consist of several layers and elements of different materials. These layers and elements are combined with the goal to arrange them in such a way that they will absorb the bending and torsion loads that occur when the ski is used and give the ski the respective degree of stiffness and elasticity required by the user. The mutually interlocking elements are connected with a strong glue joint.

DE-OS 38 03 535 describes a ski with a body that contains a core extending over practically the total length of the ski. This core is surrounded by a box designed to offer resistance to the various occurring mechanical forces. The box has an upper and a lower resistance lamella which are mutually connected by means of two lateral resistance walls. The core in the middle of the box can consist of different materials such as wood, synthetic foam or other materials of cellular structure. However, it can also be partly hollow, which means that it can consist, for example, of metal or plastic tubes. The deformation properties and the running characteristics of this well-known ski are mainly due to the shape of the box and the deformation resistance ensured by the resistance lamellas and resistance walls.

DE-OS 24 33 673 describes a ski with a longitudinal core of hollow, tube-shaped elements. The core furthermore contains ribs that connect the elements and keep the tube-shaped elements parallel and at a fixed distance. The result are longitudinal grooves between the tube-shaped elements. These grooves are filled with a filling material. The running surface of the ski consists of a level lower plate that is glued to the bottom surface of the core. The core consists preferably of two identical corrugated plates arranged symmetrically one on top of the other. The surfaces where the two elements meet are glued together. The compromise between ski stiffness and ski elasticity can be modified by changing the thickness of the adhesive.

EP-A-00 81 834 describes another ski with a box. Surrounded by the box, the core of the ski contains two parallel longitudinal plastic tubes that are increasingly flattened towards their ends. A metal plate mounted above the tubes holds the binding. The core surrounding the tubes consists of a cellular expanded plastic such as polyurethane foam that is shaped around the tubes.

A technique used for the production of metal skis is described in DE-OS 15 78 700. The upper part of the metal ski is provided with a plastic vibration reduction covering. The edges of the vibration reduction covering are glued to the top layer of the ski.

SUMMARY OF THE INVENTION

A connection or sealing strip of elastic foam material carrying a layer of adhesive can be used to glue the vibration reduction covering to the ski.

The proposed invention is intended to create a ski of the type described by way of introduction that is characterized by good torsion resistance and bending elasticity and guarantees even running and good absorption of vibrations.

These requirements are met by combining at least two shaped elements that extend over most over the length of the ski body one on top of the other. One of the elements has a longitudinal groove in which the longitudinal rib of the other element engages. The space between the two elements is filled with a layer of elastomer material that is connected with the elements by means of a shear force transmitting medium.

The characteristics of the proposed ski are mainly due to the particular shape and arrangement of the shear force transmitting elastomer layer between the elements. This results in a particularly efficient absorption of those vibrations which occur when skiing over uneven terrain and affect mainly the end sections of the ski. The proposed method thus ensures more even running and better traction on the snow surface, which improves the ski's straight running properties, the steering characteristics and ski response to changes in direction. Additionally, the elastomer layer functions as an anti-shock pad. Lateral forces such as edge pressure and edge grip manifest themselves mainly in the form of pressure on the elastomer layer due to the interlocking arrangement of the main elements. This means that such lateral forces can be very efficiently absorbed.

The elastomer layer is recommended to extend over most of the width of the ski body.

The elements can be differently shaped. However, particular advantages have been shown to be due to a design in which the surfaces bordering on the elastomer layer are curved across the length of the main elements. Particularly good properties can be achieved if these surfaces almost take the shape of a cylinder or cone section. A good relationship between the height and width of the ski body and particularly favourable deformation and anti-shock characteristics can be achieved by implementation of another method proposed as part of the invention. The running surface of the ski is provided with two parallel anti-shock elements that are inserted in parallel cavities in a third element, i.e. a supporting element, that extends over both anti-shock elements. The supporting element should have two parallel grooves in which the two anti-shock elements can be inserted. The depth of the grooves and the height of the anti-shock elements to be inserted into the grooves both decrease from the middle section, i.e. the section carrying the binding, towards the ends of the elements. The favourable shape of the ski can be further enhanced by increasing the width of the elements from the middle section carrying the binding towards the ends of the ski. Inserted in the grooves, the anti-shock elements have a largely level surface on the exterior side, i.e. the side opposite to the elastomer layer. This surface is on the same level as the edges of the grooves. Thus, the three elements are combined into one united contact surface for an element that can function either as the running surface or the top surface of the ski, e.g. a resistance element.

Particularly favourable ski characteristics can be ensured by manufacturing the elements in the shape of tubes with walls of a highly resistant material such as metal, a fibre material or fibre-reinforced plastic. The tubes can be either hollow or filled with a filling material, preferably of low density.

The invention furthermore proposes the possibility of resistance strips of a highly resistant material to be inserted between the elements and the running surface of the ski. The number of resistance strips and/or the material thickness and/or the strip width can vary depending on the type of application for which the ski is intended. Resistance strips are recommended to bridge the gap between the individual elements in the area of the elastomer layer. Additionally, a frictional connection can be established between the resistance strips and the steel edges on both sides of the running surface, thus ensuring better hold of the steel edges. The material recommended for the resistance strips is a titanium alloy.

An additional proposal consists of an element with one or several cavities that is provided with resistance walls along its lateral edges. The height of the resistance walls can decrease together with the construction height of the element from the middle section carrying the binding towards the ends of the element. The space between the grooves and/or the resistance walls is recommended to be filled with a filling material. Another option proposed as part of the invention is to build a box around the elements for better mechanical resistance. The box can consist of fibre-reinforced plastic and/or metallic, thermoplastic and/or duroplastic materials. The exterior shape of the box varies with the type of application and geometry of the ski and depends mainly on the shape and, thus, on the exterior contour of the interconnected elements. The hollow spaces between the elements and the box can be filled with a filling material.

BRIEF DESCRIPTION OF THE DRAWINGS

The invention is explained by means of a practical example illustrated in the following figures:

FIG. 1: top view of a ski manufactured according to the proposed method;

FIG. 2: cross section (along line A—A) through the ski illustrated in FIG. 1;

FIG. 3: cross section (along line B—B) through the ski illustrated in FIG. 1;

FIG. 4: cross section (along line C—C) through the ski illustrated in FIG. 1;

DETAILED DESCRIPTION OF THE INVENTION

Figure 5:
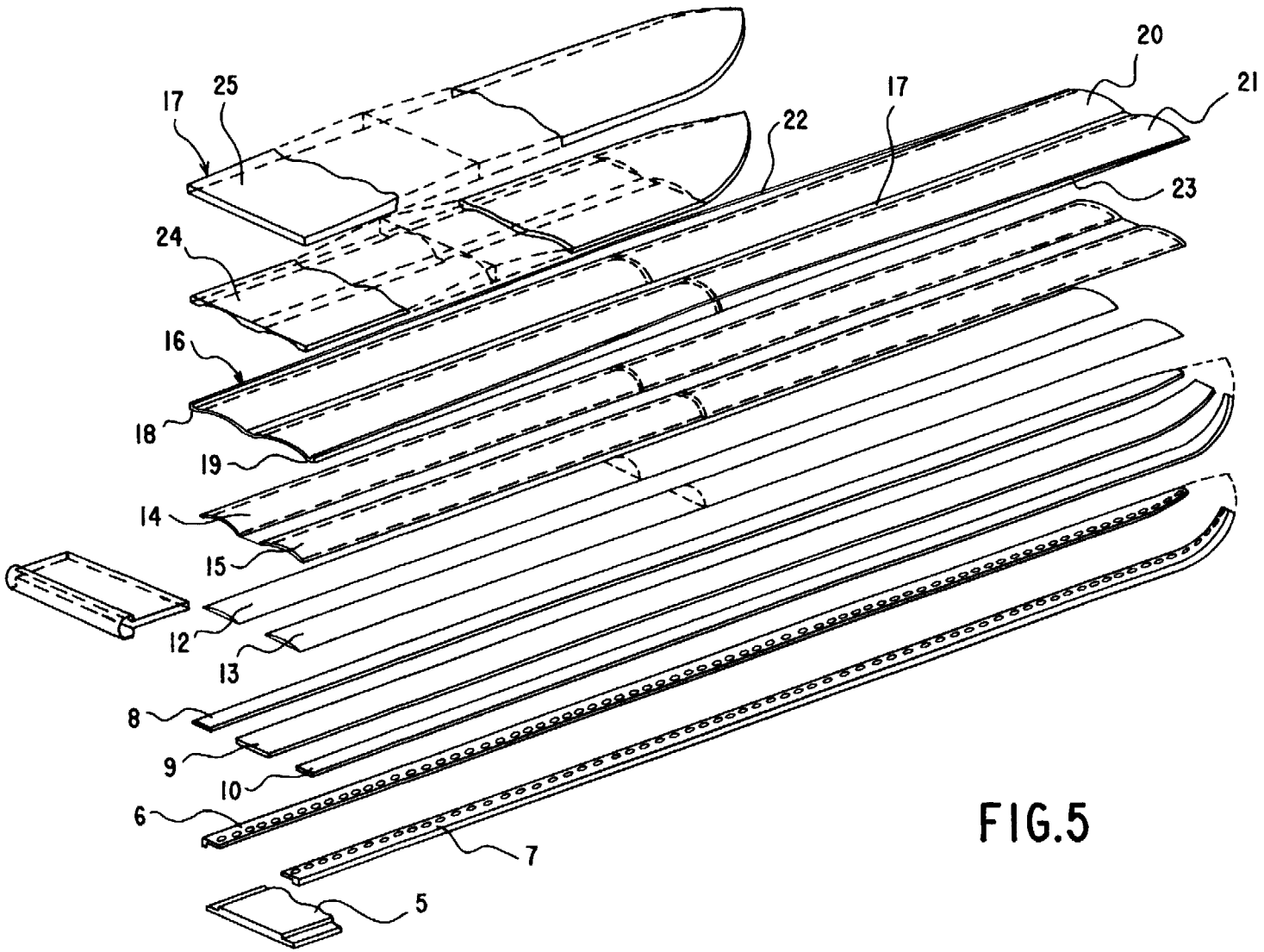
FIG. 5: perspective view of the individual elements constituting the ski illustrated in FIG. 1.

The ski illustrated in FIG. 1 is not shown in its actual length. It consists of a front section (1) with a tip (2), a middle section (3) and a rear section (4). The front (1) and the rear section (4) are wider than the middle section (3). The cross sections illustrated in FIGS. 2–4 show that the middle section (3) of the ski is higher/thicker than the front section (1) and the rear section (4). The different thickness of the various sections of the ski is due to the different bending forces to which the respective parts are exposed and ensures that the forces acting on the ski are equally distributed from the middle section (3) over the entire length of the ski.

The body of the ski consists of the following different elements and layers:

The bottom of the ski is the running surface (5) that consists of a thin sheet of plastic material such as polyethylene. The lateral edges of the running surface (5) are provided with steel edges (6, 7). The running surface (5) and the steel edges (6, 7) are provided with resistance strips (8, 9, 10) consisting of a titanium alloy. Resistance strip (9) is glued to the running surface (5), while strips (8) and (10) are glued to both the running surface (5) and the steel edges (6, 7). The space between the resistance strips (8, 9, 10) is filled with a layer of filling material (11) that corresponds in thickness to the resistance strips.

The resistance strips (8, 9, 10) carry two anti-shock elements (12, 13) that bridge the two layers of filling material (11). The cross section of these anti-shock elements is a circle segment and varies over the length of the ski. The flat bottom of the anti-shock elements is glued onto the resistance strips (8, 9, 10). The anti-shock elements (12, 13) consist of long tubes of glass or carbon fibre-reinforced plastic. The hollow space within the tubes is filled with a filling material. The filling material can consist of inorganic and/or organic powders, short and/or longer fibres, tissue scraps and/or grainy materials consisting of granules or grains of any shape. The upper sides of the anti-shock elements (12, 13) are curved and covered with an anti-shock layer (14, 15) of an elastomer material such as silicone rubber.

The anti-shock elements (12, 13) and the anti-shock layers (14, 15) are covered by a supporting element (16) that has a middle rib (17) and two lateral ribs (18, 19) that rest on and are fixed to the resistance strips (8, 9, 10). The anti-shock layers (14, 15) are glued to the anti-shock elements (12, 13) and the supporting element (16). This enables them to absorb shear forces. The supporting element (16) consists of a profiled tube. The exterior surface consists of a wall of highly resistant glass or coal fibre reinforced plastic and encloses a hollow space filled with a filling material of lower density and resistance. The supporting element (16) has two grooves (20 and 21). With a circular arc cross section, these grooves are connected by a middle rib (17). The narrowest part of the grooves (20, 21) is located in the middle section (3) of the ski where they are more pronouncedly curved. Towards the ends of the ski these grooves become increasingly wider and more shallow and, consequently, less curved. The exterior sides of the lateral ribs (18, 19) of the supporting element (16) have resistance walls (22, 23) consisting of two wall layers of the supporting element (16) glued together one on top of the other. The resistance walls reach their largest height in the middle section (3). Towards the ends of the supporting element (16) the height decreases. The resistance walls (22, 23) serve to stabilize the lateral edges of the ski, thus contributing to the overall bending strength.

The top surface of the supporting element (16) is covered by a dimensionally stable layer of filling material (24) that fills the cavities in the top surface of the supporting element (16) to both sides of the grooves (20, 21) and, thus, creates an even surface. The layer of filling material is covered by a top layer (25) that extends around the resistance walls (22, 23) on the sides and consists of carbon fibre-reinforced plastic. The top layer (25) is glued to the layer of filling material (24) and the resistance walls (22, 23).

The described ski is marked by a regular variation pattern of the resistance properties along the length of the ski body. The proposed design ensures that the forces acting on the running surface are distributed in direct proportion to the length and width of the ski. The result is a favourable distribution of the surface pressure and edge load, which ensures that the ski runs straight and evenly and offers good steering characteristics. The design of the supporting element, the anti-shock elements and the fact that they are connected by the anti-shock layer guarantee a favourable compromise between ski stiffness and elasticity and ensures a high degree of torsion stiffniess. Additionally, the anti-shock layer efficiently absorbs vibrations, which improves the even running qualities of the ski. On the whole, it has been shown that skis manufactured according to the proposed method allow extraordinarily good control over the ski regardless of the prevailing snow and piste conditions. Additionally, the proposed method ensures a ski that will respond optimally to changes in direction and offer excellent curve acceleration properties.

Figure 6:
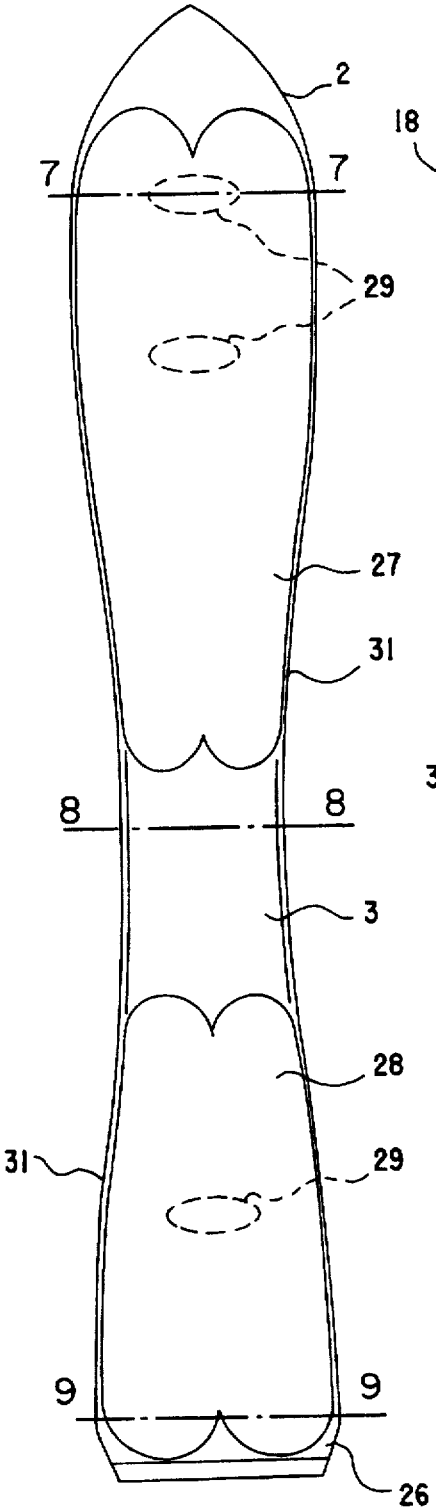
FIG. 6: top view of a different variety of ski manufactured according to the proposed method.
Figure 7:
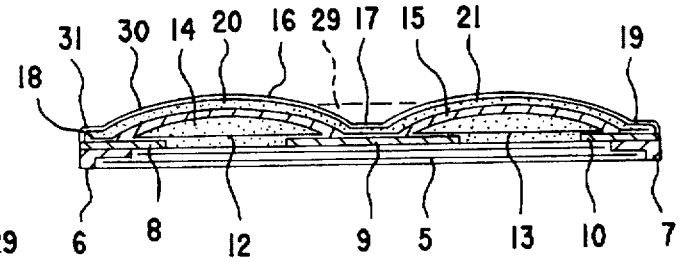
FIG. 7: cross section (along line A—A) through the ski illustrated in FIG. 6.
Figure 8:
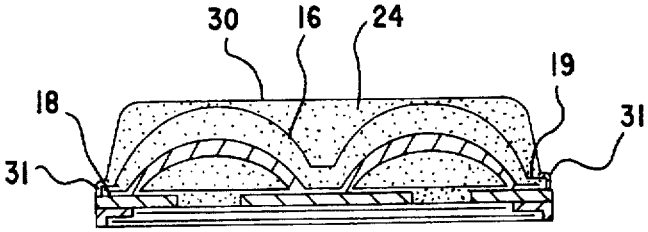
FIG. 8: cross section (along line B—B) through the ski illustrated in FIG. 6.
Figure 9:
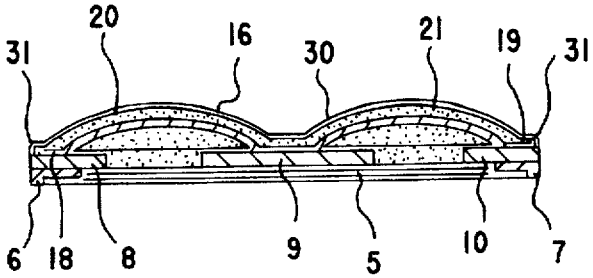
FIG. 9: cross section (along line C—C) through the ski illustrated in FIG. 6.

The ski illustrated in FIGS. 6–9 has the same basic structure as the ski illustrated in FIGS. 1–5. Identical construction elements are, therefore, indicated by identical reference numbers. However, to reduce the weight of the ski, the upper side of the supporting element (16) with the two longitudinal ribs inserted into the grooves (20, 21), has been only partly covered with filling material, i.e. only in the middle section (3) carrying the binding. The upper side of the supporting element (16) is in sections 27 and 28 either only glued to a mechanical reinforcement layer or it can be exposed save for a thin protective or decorative layer. Additional ribs (29, see broken line in the drawings) can be integrated between the two elevations in sections 27 and 28 for greater stiffness and better transmission of forces from the edges. The number of cross ribs (29) can be adjusted to the respective requirements in terms of stiffness.

The lateral ribs (18, 19) of the upper and lower wall layers of the supporting element (16) are directly connected (e.g. by a bonding agent) in the ski illustrated in FIGS. 6–9. The exterior edges of the lateral ribs (18, 19) of the upper wall layer are folded downwards so that they cover the exterior edge of the bottom wall layer of the supporting element (16).

The top of the supporting element (16) is covered by a thin-walled shaped element (30) of fibre material that is adjusted to the shape of the supporting element (16) in sections 27 and 28 and bonded to the supporting element (16). In section 3 this shaped element (30) is designed as a trapezoid box to allow mounting of the binding. The space between the shaped element (30) and the supporting element (16) is filled with a dimensionally stable layer of filling material (24). The shaped element (30) and the supporting element (16) are increasingly flattened towards the tip (2) and the end (26) of the ski. There, they are directly glued to the resistance strips 8–10 and the running surface (5). The edge of the shaped element (30) is shaped like an angular ledge (31) that rests on the lateral ribs (18, 19) and extends around the latter on the exterior side. The angular ledge (31) is bonded to the edge ribs (18, 19). Thus, a robust lateral rib is created that can be partly ground off.

Tested in practice, the basic method that has been described so far allows a number of variations all based on the general principle of the invention. It is, for example, possible to vary the number of elements that serve as anti-shock elements and supporting elements. It could, for instance, be sufficient for a less sophisticated model to use only one anti-shock element and one supporting element with one anti-shock layer in between. On the other hand, it is also possible to increase the number of anti-shock elements. It is, for example, possible to arrange anti-shock elements on both sides of the supporting element. The cross section of both the ski body and the elements connected by means of the anti-shock layer can be varied. It is, for example, possible to have differently inclined resistance walls on either side of the ski. The anti-shock elements can consist of tubes that have a cylindrical cross section in the middle and are flattened to an increasingly oval cross section towards the ends. Additionally, it is possible to design these elements as solid structures consisting of one single material such as a duroplastic or thermoplastic material. Fibre-reinforced elements can be manufactured in different ways with the conventional technologies and of well-tried plastics. The reinforcing inserts may consist of glass fibre, carbon fibre, aramide fibre and carbonised and graphitized fibres. Furthermore, it is possible to insert resistance strips of metal within or below the cover layer.

I claim:

1. A snow ski, comprising:

a ski body;

a supporting element disposed on an upper surface of said ski body, said supporting element defining two parallel first longitudinal cavities between an upper surface of the ski body and a lower inner surface of the supporting element, said cavities extending substantially along a length of the ski;

two anti-shock elements, one of said two anti-shock elements disposed in each of said first longitudinal cavities, each of said anti-shock elements having a shape which essentially corresponds to a shape of said first longitudinal cavity, wherein a lower surface of each anti-shock element is bonded to the upper surface of the ski body; and an elastomeric anti-shock layer disposed in each of said first longitudinal cavities between an upper surface of each anti-shock element and said lower inner surface of said supporting element, said anti-shock layer being connected to said lower inner surface of said supporting element and said upper surface of said anti-shock element by shear force transmitting means.

2. A snow ski as recited in claim 1, wherein each anti-shock element defines a second longitudinal cavity below a lower surface thereof, said ski further comprising a filler material filling said second longitudinal cavity.

3. A snow ski as recited in claim 1, wherein said ski body comprises:

a running surface layer having two longitudinal sides, an upper surface, and a lower surface;

edges fixedly attached to each of said two longitudinal sides;

a reinforcing layer disposed on the upper surface of the running surface layer and an upper surfaces of each of the edges, wherein said reinforcing layer is bonded to the respective upper surfaces.

4. A snow ski according to claim 3, wherein said reinforcing layer comprises at least two longitudinal reinforcing strips disposed in a parallel configuration along a length of the running surface layer with a gap therebetween, wherein said gap is filled with a gap filling material.

5. A snow ski according to claim 3, wherein said longitudinal cavities define two convex bulges which are semi-circular in cross section and which extend in a longitudinal direction.

6. A snow ski according to claim 5, wherein said semi-circular bulges have cross sections which vary along the length of the ski.

7. A snow ski according to claim 6, where each anti-shock element has a shape and a varying cross section which corresponds to an inner surface of the supporting element.

8. A snow ski as recited in claim 3, wherein said running surface layer, said edges, said reinforcing layer, said supporting element and said anti-shock elements are securely bonded together.

9. A snow ski as recited in claim 3, wherein said supporting element includes longitudinal edge portions having a first surface extending outwardly by a first distance in a direction which is parallel to the upper surface of the ski body, and a second surface extending upwardly from the first surface by a second distance in a direction which is perpendicular to an upper surface of the ski body.

10. A snow ski as recited in claim 9, wherein said first distance and said second distance varies along a length of the ski.

11. A snow ski as recited in claim 5, wherein an outer surface of the contour layer includes a groove between the convex bulges, said groove being filled with a filler material.

12. A snow ski as recited in claim 6, wherein a height of the convex bulges at a central portion of the ski is greater than a height of the convex bulges at distal ends thereof.

13. A snow ski as recited in claim 5, wherein a width of said convex bulges at a central portion of the ski is less than a width of the bulges at distal ends thereof.

14. A snow ski as recited in claim 9, wherein an upper surface of the ski is encapsulated by an encapsulating element.

15. A snow ski as recited in claim 4, wherein said supporting element and said anti-shock elements comprise metal.

16. A snow ski as recited in claim 4, wherein said supporting element and said anti-shock elements comprise fiber material.

17. A snow ski as recited in claim 4, wherein said supporting element comprises a fiber-reinforced plastic material.

18. A snow ski as recited in claim 4, wherein said filler material is a low-density filler material.

19. A snow ski as recited in claim 5, wherein said reinforcing layer comprises at least two longitudinal reinforcing strips disposed in a parallel configuration along a length of the running surface layer with a gap therebetween, wherein one of said at least two longitudinal reinforcing strips is configured at a position on the ski body wherein, in cross section and with the ski body as a bottom layer, the one reinforcing strip is under a longitudinal edge of one of the anti-shock elements, a portion of the anti-shock layer, and the a portion of the supporting element.

* * * * *